US006942324B2

(12) United States Patent
Campion et al.

(10) Patent No.: US 6,942,324 B2
(45) Date of Patent: Sep. 13, 2005

(54) FLUID DELIVERY SYSTEM FOR AN INK JET PRINT HEAD

(76) Inventors: Kevin R. Campion, 15400 Highland Heights Dr., Minnetonka, MN (US) 55345; Aaron G. Barclay, 3397 Spring Glen Cir., Prior Lake, MN (US) 55372

( * ) Notice: Subject to any disclaimer, the term of this patent is extended or adjusted under 35 U.S.C. 154(b) by 112 days.

(21) Appl. No.: 10/685,195

(22) Filed: Oct. 14, 2003

(65) Prior Publication Data

US 2005/0078155 A1 Apr. 14, 2005

(51) Int. Cl.[7] ..... B41J 2/175
(52) U.S. Cl. ..... 347/85
(58) Field of Search ..... 347/5, 7, 84, 85, 347/86, 87

(56) References Cited

U.S. PATENT DOCUMENTS 3,967,286 A 6/1976 Andersson et al.
4,074,284 A 2/1978 Dexter et al.
4,399,466 A 8/1983 Stephenson
4,432,005 A * 2/1984 Duffield et al. ..... 347/86
4,462,037 A 7/1984 Bangs et al.
4,680,696 A 7/1987 Ebinuma et al.
4,831,389 A 5/1989 Chan
4,959,667 A 9/1990 Kaplinsky
4,967,207 A 10/1990 Ruder
4,968,998 A 11/1990 Allen
4,999,652 A 3/1991 Chan
5,136,305 A 8/1992 Ims
5,189,438 A * 2/1993 Hine et al. ..... 347/89
6,164,766 A 12/2000 Erickson
6,234,615 B1 * 5/2001 Tsukuda ..... 347/85

* cited by examiner

*Primary Examiner*—Anh T. N. Vo
(74) *Attorney, Agent, or Firm*—Carmody & Torrance LLP

(57) ABSTRACT

A fluid delivery system of the invention comprises one or more intercoupled cartridge assembles. Each cartridge assembly comprises a plurality of interconnected cartridges, each comprising a reservoir for holding jetting fluid and an ink jet print head operatively connected to the reservoir. Each cartridge assembly is interconnected by a first interconnection assembly and a second interconnection assembly. The first interconnection assembly maintains the plurality of interconnected cartridges at a negative pressure. The second interconnection assembly maintains at least an essentially equal level of jetting fluid within each of the reservoirs of the plurality of cartridges. Jetting fluid is replenished in the plurality of interconnected cartridges by replenishing jetting fluid in a selected cartridge and using the second interconnection assembly to distribute the jetting fluid among the reservoirs of the interconnected cartridges. A sensor is coupled to the selected reservoir to monitor the level of jetting fluid in the cartridge assembly.

17 Claims, 4 Drawing Sheets

FLUID DELIVERY SYSTEM FOR AN INK JET PRINT HEAD

FIELD OF THE INVENTION

The present invention relates to an improved fluid delivery system for an ink jet print head comprising a set of reservoirs for holding a jetting fluid operatively connected to a corresponding set of ink jet print heads.

BACKGROUND OF THE INVENTION

Automatic ink supply and refill systems for ink jet printers are also well known. Automatic ink supply and refill systems can be classified either as passive refill systems, which rely on gravitational or pressure differentials to cause the ink to flow through the system, or active systems, which use a pump or mechanical assist to move the ink through the system.

Active ink refill systems have been used with either a continuous ink supply system, such as described in U.S. Pat. Nos. 4,399,466, 4,462,037 and 4,680,696, or an on-demand ink supply system, such as described in U.S. Pat. Nos. 4,074,284 and 4,432,005, the subject matter of each of which is herein incorporated by reference in its entirety. These active ink refill systems rely on atmospheric or positive pressure hydrodynamic conditions to supply ink to the print nozzles.

Passive ink refill systems use gravity to feed ink. In one example, described in U.S. Pat. No. 4,959,667, the subject matter of which is herein incorporated by reference in its entirety, the system is controlled by a three-way valve to feed ink from an ink reservoir to an ink supply container as part of a single replaceable unit that is carried by the print carriage. The drawback to this system is that when the print heads are printing on large media, print head performance may be greatly diminished if the weight and volume of the large reservoir of ink needs to be supported by the print carriage as it traversed across the print medium.

To overcome the drawback of supporting a large reservoir of ink on the print carriage, many prior art ink delivery systems involve a service station which refills the ink jet cartridge only when the print carriage is at one or the other end of the print axis so that the ink jet cartridges can be docked with the service station. Once docked, the ink reservoir in the ink jet cartridge is quickly refilled and the print carriage is allowed to return to its printing operation. Various examples of service station-type ink refill systems for ink jet cartridges are shown in U.S. Pat. Nos. 3,967,286, 4,831,389, 4,967,207, 4,968,998, 4,999,652 and 5,136,305, the subject matter of each of which is herein incorporated by reference in its entirety.

There are two basic problems with service station-type ink refill systems. First, the print speed of the ink jet printer is decreased by the time required to perform the docking and refill operation. Second, in order to minimize the time of the docking and refill operation, the ink is quickly transferred to the ink jet cartridge at a pressure that typically exceeds the nominal hydrodynamic properties of the ink jet cartridge. As a result, there may be leaking or weeping of the print heads during the refill operation, resulting in poor print quality.

U.S. Pat. No. 6,164,766 to Erickson, the subject matter of which is herein incorporated by reference in its entirety, describes an ink delivery system for an ink jet printer that includes an ink jet cartridge removably mountable in the print carriage and constructed as a self-contained unit that includes a print head and an ink supply container that stores a first quantity of liquid ink at a given negative pressure hydrodynamic condition. An ink reservoir external to the print carriage stores a second quantity of ink for replenishing the first quantity of ink in the ink supply container. The external ink reservoir is coupled to the ink supply container in the ink jet cartridge to supply ink from the second quantity of ink to the first quantity of ink during operation of the ink jet printer as the print carriage traverses across the print medium.

While the improved ink delivery system of Erickson no longer requires a service station assembly, the drawback to this system is that it requires that each printer cartridge be separately connected to, and refilled from, the external ink reservoir (or reservoirs). In addition, the ink level in each individual cartridge is separately monitored.

As is readily seen, there remains a need in the art for an improved ink delivery system that solves the problems of the prior art.

The present invention comprises an improved fluid delivery system comprising a plurality of intercoupled cartridge assembles. Each cartridge assembly comprises a plurality of interconnected cartridges, each interconnected cartridge comprising a reservoir for holding a jetting fluid, wherein the reservoir is operatively connected to an ink jet print head. Each cartridge assembly is interconnected by a first interconnection assembly and a second interconnection assembly. The first interconnection assembly maintains the plurality of interconnected cartridges at a negative pressure. The second interconnection assembly maintains at least an essentially equal level of the jetting fluid within each of the reservoirs of the plurality of fluid cartridges. In the improved fluid delivery system of the invention, the jetting fluid is replenished in the plurality of interconnected cartridges by replenishing jetting fluid in a selected cartridge. The second interconnection assembly is used to distribute the jetting fluid among the reservoirs of the interconnected cartridges. A sensor is coupled to the selected reservoir to monitor the level of jetting fluid in the cartridge assembly.

SUMMARY OF THE INVENTION

The improved fluid delivery system of the invention comprises one or more intercoupled cartridge assemblies, wherein each intercoupled cartridge assembly may contain a different jetting fluid and wherein each intercoupled cartridge assembly comprises:

a. a plurality of interconnected cartridges, each of the interconnected cartridges comprising a reservoir for holding jetting fluid, wherein each reservoir is operatively coupled to an ink jet print head;

b. a first interconnection assembly for interconnecting the plurality of interconnected cartridges and for maintaining said plurality of interconnected cartridges at a negative pressure; and c. a second interconnection assembly for maintaining at least an essentially equal level of jetting fluid within each of the reservoirs of the plurality of interconnected cartridges when jetting fluid is being held therein.

The fluid delivery system also comprises a sensing assembly operatively coupled to the reservoir of a selected one of the plurality of interconnected cartridges that monitors a level of jetting fluid in the reservoir of the selected cartridge. The reservoir of the selected cartridge further comprises an aperture for permitting replenishment of the jetting fluid to the reservoir from a remote source. The second interconnection assembly allows for the distribution of the jetting fluid among the reservoirs of the plurality of interconnected cartridges to maintain the at least essentially equal level of the jetting fluid within each of the reservoirs in the plurality of interconnected cartridges.

DETAILED DESCRIPTION OF THE PREFERRED EMBODIMENTS OF THE INVENTION

The invention comprises an improved fluid delivery system comprising one or more intercoupled ink cartridge assemblies.

Figure 1:
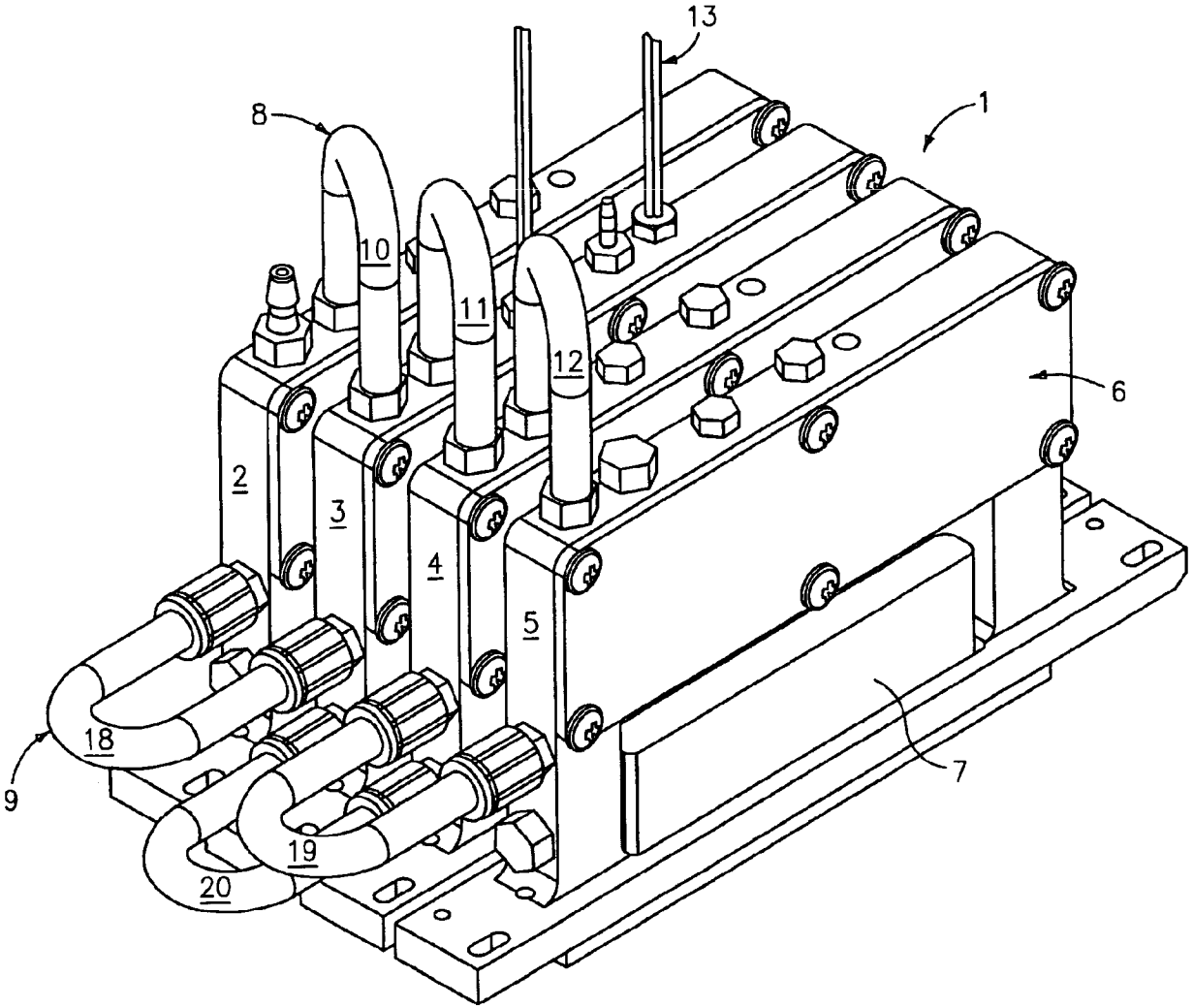
FIG. 1 is a perspective view of a fluid delivery system of the present invention.
Figure 2:
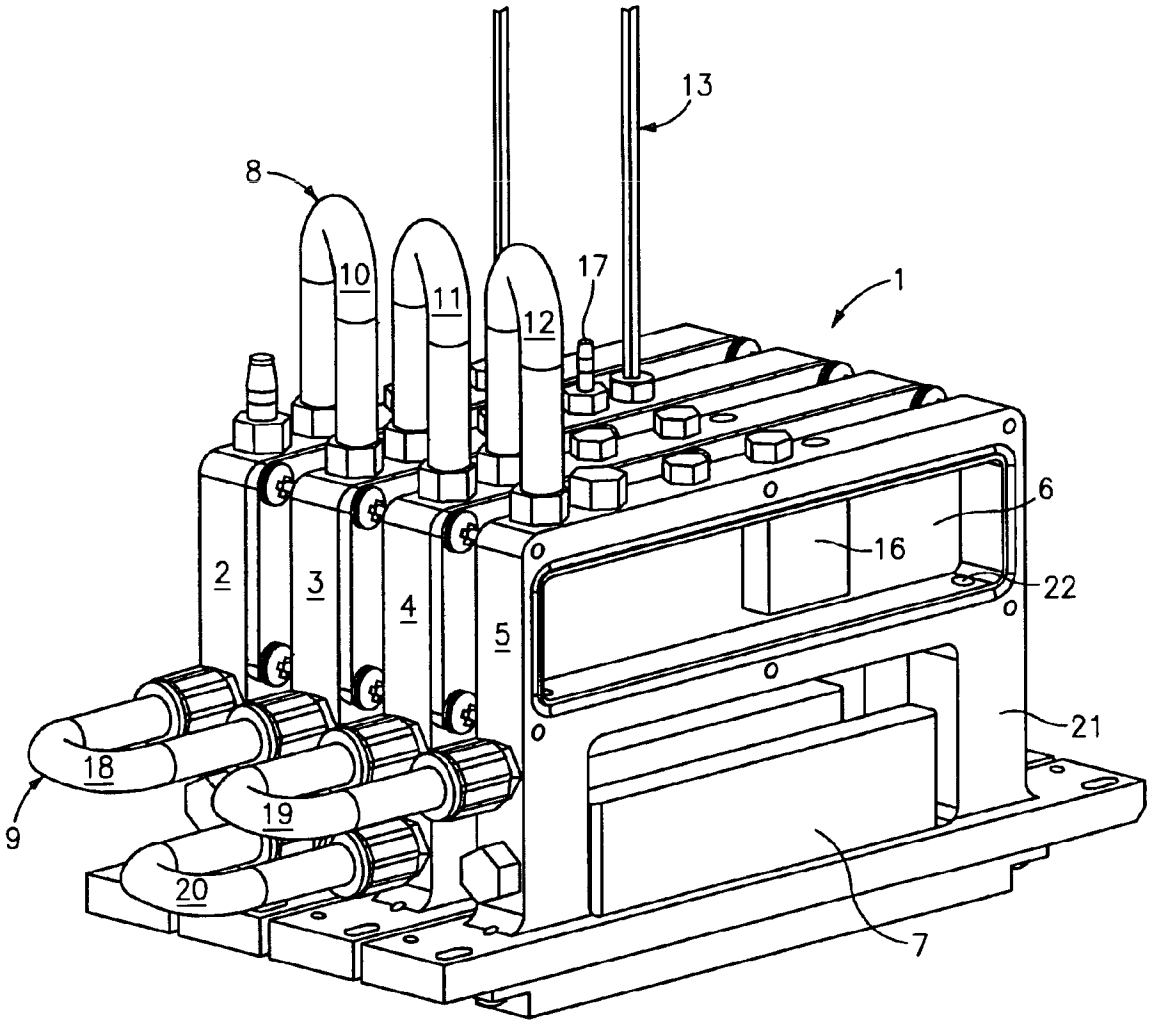
FIG. 2 is a different perspective view of the fluid delivery system of the invention, and shows the cartridge assembly of the invention with a side removed on the reservoir to show internal features of the reservoirs of the interconnected cartridges.
Figure 3:
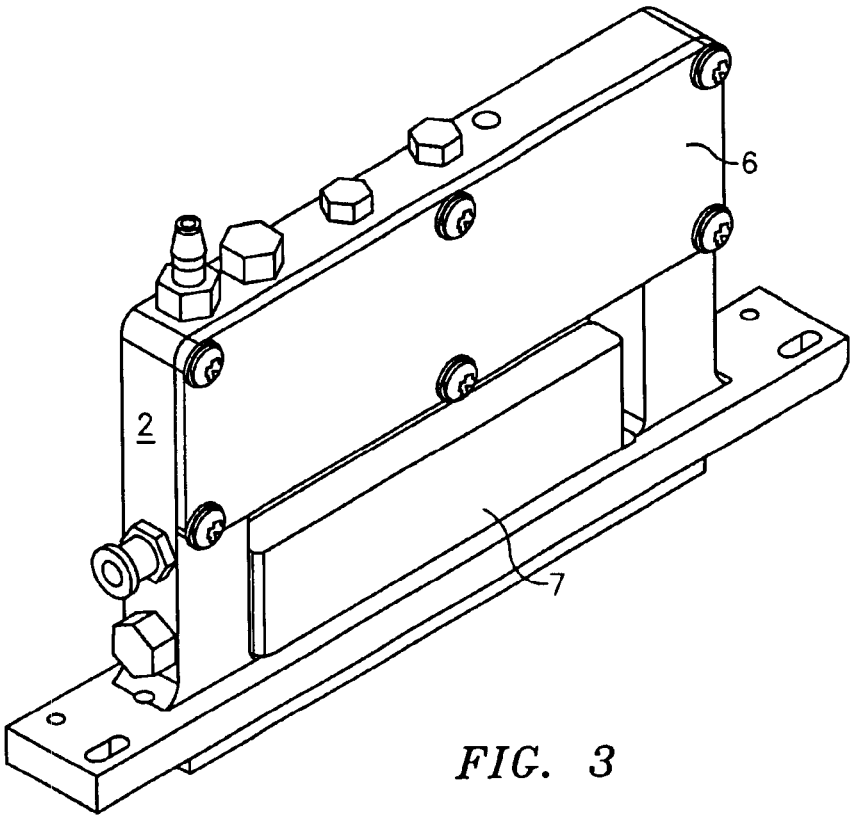
FIG. 3 shows a single cartridge element of the plurality of interconnected cartridges in the fluid delivery system of the invention.

FIGS. 1 and 2 depict a typical cartridge assembly (1) of the invention. The cartridge assembly (1) comprises a plurality of interconnected cartridges (2), (3), (4), and (5). Each of said interconnected cartridges (2), (3), (4), and (5) comprises a reservoir (6) for holding a jetting fluid, and each reservoir (6) is operatively coupled to an ink jet print head (7). While reference is made to a jetting fluid, one skilled in the art would know that the jetting fluid could be an ink, although the invention is not limited to ink.

A first interconnection assembly (8) is used for interconnecting the plurality of interconnected cartridges (2), (3), (4), and (5) and for maintaining the plurality of interconnected cartridges (2), (3), (4), and (5) at a negative pressure. A second interconnection assembly (9) is used to maintain at least an essentially equal level of the jetting fluid within each of the reservoirs (6) when jetting fluid is being held therein.

The first interconnection assembly (8) comprises a plurality of conduits (10), (11), and (12) operatively connecting together at least two reservoirs (6) of the plurality of interconnected cartridges (2), (3), (4), and (5). Negative pressure is maintained in the fluid delivery system to prevent leaking or weeping of the jetting fluid from print head orifices (not shown) of the ink jet print head (7). An aperture (25) may be used to provide the system with negative pressure.

FIGS. 1 and 2 show four interconnected cartridges (2), (3), (4) and (5) operatively connected to each other by three conduits (10), (11), and (12). As is readily apparent, the number of conduits required will depend on the number of interconnected cartridges used in the system. While a fluid delivery system comprising four interconnected cartridges is shown, the invention is not limited to four interconnected cartridges. The inventors have determined that each cartridge assembly (1) can contain up to eight or more interconnected cartridges.

The cartridge assembly (1) also comprises a sensing assembly (13) operatively coupled to the reservoir (6) of a selected one of the plurality of interconnected cartridges (3), for measuring a level of jetting fluid in the reservoir (6) of the selected cartridge (3). Non-limiting examples of the sensing assembly (13) include thermocouples, floats, ultrasonic sensors, etc. Other sensing assemblies would also be known to those skilled in the art.

Figure 4:
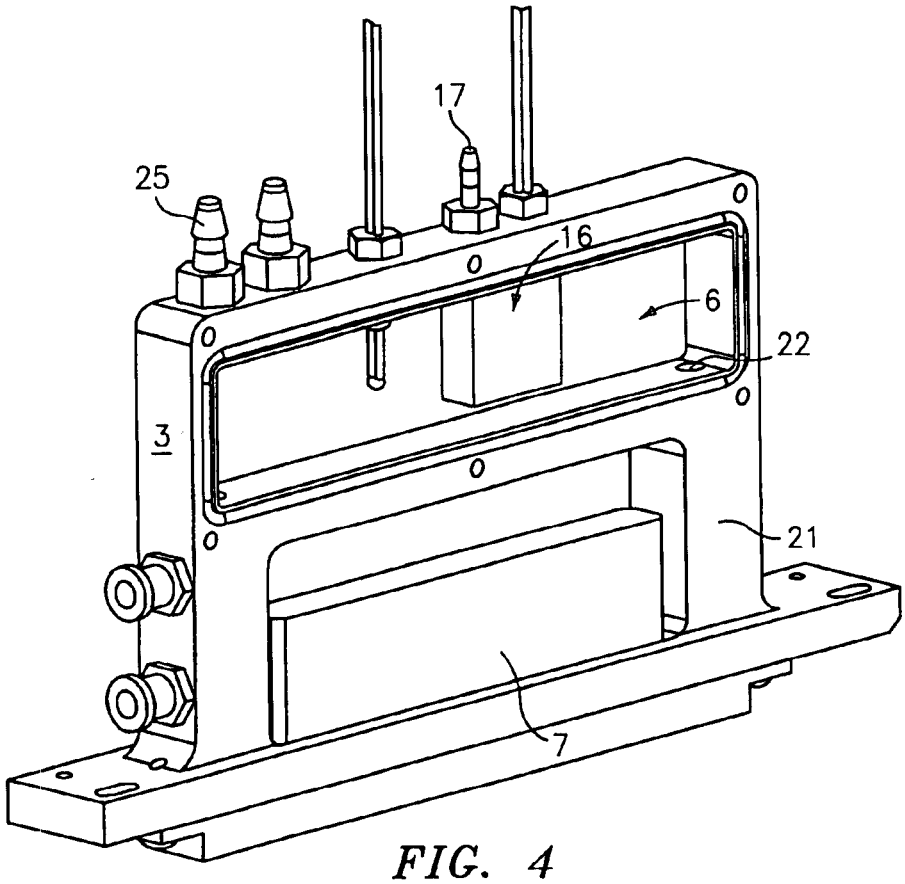
FIG. 4 shows a single cartridge element of the invention with a side removed on the reservoir to show internal features of the reservoir of the cartridge element.

As shown in FIGS. 2 and 4, the reservoir (6) of one of the plurality of cartridges (2), (3), (4), and (5) may further contain a chamber (16) that is open to the atmosphere and closed to jetting fluid in the reservoir (6).

The reservoir (6) of the selected cartridge (3) also contains an aperture (17) for permitting replenishment of jetting fluid to the reservoir (6) from a remote source (not shown). The aperture (17) may extend into the reservoir (6) of the selected cartridge, so that the jetting fluid is introduced into the reservoir (6) below the level of jetting fluid in the reservoir (6). The second interconnection assembly (9) allows for the distribution of jetting fluid among the reservoirs (6) of the plurality of interconnected cartridges (2), (3), (4), and (5) so as to maintain the at least essentially equal level of jetting fluid within the plurality of interconnected cartridges (2), (3), (4) and (5).

In a preferred embodiment, the second interconnection assembly (9) comprises a plurality of conduits (18), (19) and (20) operatively connecting together at least two of the reservoirs (6) of the plurality of interconnected cartridges (2), (3), (4), and (5).

The reservoirs (6) of the plurality of cartridges (2), (3), (4) and (5) comprise an assembly (21) for coupling the reservoir (6) to its associated ink jet print head (7). Each of the reservoirs (6) and its associated ink jet print head (7) are operatively connected by channels (22) in the assembly (21) to allow jetting fluid to interface between the reservoir (6) and its associated print head (7).

The invention described herein also contemplates a fluid delivery system comprising a plurality of intercoupled cartridge assemblies (1), wherein each intercoupled cartridge assembly contains the same or a different fluid. In one embodiment, the different fluids are different color inks. Each intercoupled cartridge assembly comprises a plurality of interconnected cartridges, as described above.

Figure 5:
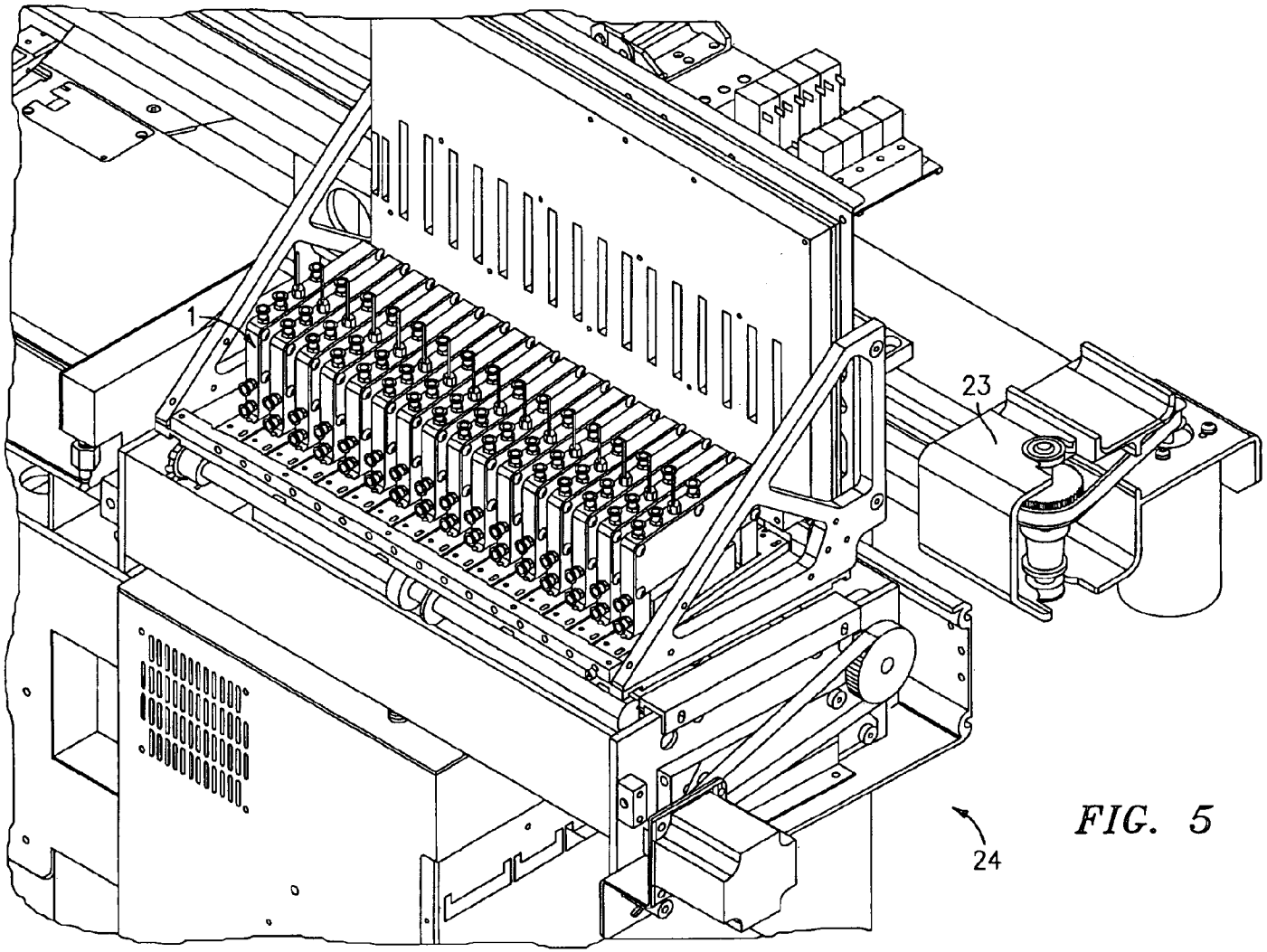
FIG. 5 shows the fluid delivery system in one embodiment of the invention wherein the fluid delivery system is mounted on a carriage assembly of an ink jet printer.

As shown in FIG. 5, in one embodiment of the invention, the cartridge assembly (1) of the invention is mounted on a reciprocating carriage (23) which is in turn mounted on an ink jet printer (24). In another embodiment of the invention, the cartridge assembly is stationary and the media moves beneath the cartridge assembly. Other variations would also be known to those skilled in the art.

A key benefit to the invention is that if any of the plurality of cartridge assemblies malfunctions, or needs to be maintained or removed for any reason, the modular nature of the design enables quick removal and replacement of a cartridge of the plurality of interconnected cartridges.

The configuration also enables a free surface of jetting fluid column directly over the print inlet, which maintains a good flow of jetting fluid to the ink jet print head at all times.

The improved fluid delivery system of the invention can also supply jetting fluid faster than the maximum rate that the jetting fluid can be used, which maintains an adequate supply of jetting fluid in the ink jet print head (7) at all times. This contributes to the improved printing capabilities of the cartridges of the invention as compared to the prior art.

The fluid delivery system of the invention can be used on any ink jet printer, including large-scale printers (i.e., printers that can print media up to about 73 inches wide). The fluid delivery system can be used to supply any type of jetting fluid for printing on a variety of media, including paper, film, fabric, and vinyl.

A key feature of the invention is that when the fluid delivery system of the invention is used on a carriage that moves back and forth across the length of the printer, there is minimal sloshing due to individual printer cartridges or more cumbersome on-carriage reservoirs of the prior art. In addition, the novel fluid delivery system of the invention minimizes pressure spikes in the reservoir system by maintaining a constant negative pressure across the entire system.

What is claimed is:

1. A cartridge assembly for a fluid delivery system, the cartridge assembly comprising:

a. a first plurality of interconnected cartridges, each of said interconnected cartridges comprising a reservoir for holding a jetting fluid, wherein each reservoir is operatively coupled to an ink jet print head;

b. a first interconnection assembly for interconnecting the first plurality of interconnected cartridges, wherein the first interconnection assembly comprises a first plurality of conduits connecting together at least two reservoirs of said first plurality of interconnected cartridges; and c. a second interconnection assembly for maintaining at least an essentially equal level of the jetting fluid within each of the reservoirs when jetting fluid is being held therein.

2. The cartridge assembly of claim 1, wherein the first interconnection assembly maintains said first plurality of interconnected cartridges at a negative pressure.

3. The cartridge assembly of claim 1, wherein the first plurality of interconnected cartridges comprises at least four cartridges.

4. The cartridge assembly of claim 3, wherein the first plurality of interconnected cartridges comprises at least eight cartridges.

5. The cartridge assembly of claim 1, comprising a sensing assembly operatively coupled to the reservoir of a selected one of the first plurality of interconnected cartridges, for monitoring a level of jetting fluid in the reservoir of the selected cartridge.

6. The cartridge assembly or claim 5, wherein the reservoir of the selected cartridge comprises au aperture for permitting replenishment of jetting fluid to the reservoir from a remote source, wherein the second interconnection assembly allows for the distribution of jetting fluid among the reservoirs of the first plurality of interconnected cartridges so as to maintain the at least essentially equal level of jetting fluid within the first plurality of interconnected cartridges.

7. The cartridge assembly of claim 6, wherein said second interconnection assembly comprises a second plurality of conduits operatively connecting together at least two of the reservoirs of the first plurality of interconnected cartridges.

8. The cartridge assembly of claim 6, wherein the aperture for permitting replenishment of the jetting fluid extends into the reservoir of the selected cartridge, whereby jetting fluid is introduced into the reservoir below the level of jetting fluid in the reservoir.

9. The cartridge assembly of claim 1, wherein the reservoirs of said first plurality of cartridges comprise an assembly for coupling the reservoir to an associated ink jet print head.

10. The cartridge assembly of claim 9, wherein each of the reservoirs and its associated ink jet print head are operatively connected by channels in the assembly to allow jetting fluid to interface between the reservoir and the associated print head.

11. A fluid delivery system comprising a plurality of intercoupled cartridge assemblies, wherein each intercoupled cartridge assembly contains a different jetting fluid and wherein each intercoupled ink cartridge assembly comprises:

a. a plurality of interconnected cartridges, each of said interconnected cartridges comprising a reservoir for holding a jetting fluid, wherein each reservoir is operatively coupled to an ink jet print head;

b. a first interconnection assembly for interconnecting the first plurality of interconnected cartridges, wherein the first interconnection assembly comprises a first plurality of conduits connecting together at least two reservoirs of said first plurality of interconnected cartridges; and c. a second interconnection assembly for maintaining at least an essentially equal level of the jetting fluid within each of the reservoirs of the plurality of interconnected cartridges when jetting fluid is being held therein.

12. The fluid delivery system of claim 11, comprising a sensing assembly operatively coupled to the reservoir of a selected one of the first plurality of interconnected cartridges, for monitoring a level of jetting fluid in the reservoir of the selected cartridge.

13. The fluid delivery system of claim 12, wherein the reservoir of the selected cartridge comprises an aperture for permitting replenishment of jetting fluid to the reservoir from a remote source, wherein the second interconnection assembly allows for the distribution of jetting fluid among the reservoirs of the first plurality of interconnected cartridges so as to maintain the at least essentially equal level of jetting fluid within the plurality of interconnected cartridges.

14. The fluid delivery system of claim 12, wherein the sensing assembly measures the level of jetting fluid in the reservoir of the selected cartridge.

15. The fluid delivery system of claim 11, wherein each cartridge assembly comprises at least four interconnected cartridges.

16. The fluid delivery system of claim 15, wherein each cartridge assembly comprises at least eight interconnected cartridges.

17. The fluid delivery system of claim 11, wherein the first interconnection assembly maintains said first plurality of interconnected cartridges at a negative pressure.

* * * * *

UNITED STATES PATENT AND TRADEMARK OFFICE

CERTIFICATE OF CORRECTION

PATENT NO. : 6,942,324 B2
DATED : September 13, 2005
INVENTOR(S) : Campion et al.

It is certified that error appears in the above-identified patent and that said Letters Patent is hereby corrected as shown below:

Column 5,
Line 44, delete the word "au" and replace it with -- an --.

Signed and Sealed this

First Day of November, 2005

JON W. DUDAS
*Director of the United States Patent and Trademark Office*